US005127536A

United States Patent [19]

Cohen et al.

[11] Patent Number: 5,127,536

[45] Date of Patent: Jul. 7, 1992

[54] EXPANDABLE SHOPPING BAG

[76] Inventors: Susan Cohen, 206 Allendale Rd., Chestnut Hill, Mass. 02167; Lorraine Arnfeld, 1531 Beacon St., Brookline, Mass. 02146

[21] Appl. No.: 648,974

[22] Filed: Jan. 31, 1991

[51] Int. Cl.[5] ..... B65D 33/06

[52] U.S. Cl. ..... 224/222; 150/102; 383/16; 383/18

[58] Field of Search ..... 383/18, 16; 224/219, 224/222; 150/102; 190/101, 102, 900, 902

[56] References Cited

U.S. PATENT DOCUMENTS

| | | | |
|---|---|---|---|
| 546,168 | 9/1895 | Lobdell | 383/18 |
| 1,359,461 | 11/1920 | Luce | 190/902 |
| 1,745,590 | 2/1930 | Stanger | 190/902 |
| 3,011,173 | 12/1961 | Goetz | 383/18 |
| 3,678,977 | 7/1972 | Baumgartner | 150/102 |
| 4,062,392 | 12/1977 | Ishii | 383/16 |
| 4,164,308 | 8/1979 | Gautier | 190/101 |
| 4,273,274 | 6/1981 | Freistadt | 224/151 |
| 4,592,091 | 5/1986 | Italici | 383/15 |
| 4,881,684 | 11/1989 | Chinman | 190/119 |

*Primary Examiner*—Stephen P. Garbe
*Attorney, Agent, or Firm*—Robert L. Goldberg

[57] ABSTRACT

An expandable carrying bag having a front surface, a rear surface, two side surfaces and an open top. The bag is characterized by at least one open loop on at least one surface of said bag. The loop is of a size sufficient to accommodate insertion of a forearm therein. In use, a forearm is inserted into the loops and the bag is pressed against the body. In this way, the weight of the load within the bag is partially displaced from the bag to the forearm thereby reducing stress on the lower back muscles.

2 Claims, 1 Drawing Sheet

EXPANDABLE SHOPPING BAG

BACKGROUND OF THE INVENTION

1. Introduction

This invention relates to a shopping bag designed to reduce lower back strain when carrying heavy loads. More particularly, this invention relates to a reusable shopping bag characterized by carrying handles positioned to reduce lower back strain.

2. Description of the Prior Art

The conventional shopping bag, when filled for example with groceries, is typically carried by placing one or both arms beneath the bag and leaning the bag against the body while bending the body backwards for leverage and support. This method of transporting heavy loads places a strain on the lower back muscles that cannot be tolerated for long periods of time by a relatively large segment of the population.

Shopping bags have been designed to make the carrying of heavy loads less burdensome. For example, in U.S. Pat. No. 4,592,091, incorporated herein by reference, there is disclosed a composite carrying handle for an expandable bag that comprises a pair of handles each fastened to a side of the container and each consisting of two straps of flexible strong material, the two straps of each handle being fastened together at an intermediate section which is the section to be gripped by the user. A similar but improved composite handle is disclosed in U.S. Pat. No. 4,881,684, incorporated herein by reference.

The handles disclosed in the above-referenced patents reduce strain resulting from the carrying of heavy loads. However, the handles are designed such that the strain is shifted to one arm or the other, or alternatively, to the lower back. The carrying handles disclosed in said patents are not designed to distribute the weight of the load over a substantial portion of the body.

SUMMARY OF THE INVENTION

The subject invention is directed to an expandable bag having a front surface, a rear surface, two side surfaces and an open top. The bag is characterized by at least one open loop on one surface of the bag that is of a size and shape to accommodate insertion of a forearm into the loop. Preferably, the bag is characterized by at least two open loops on one surface of the bag that are spaced apart and in face-to-face parallel relationship to each other.

In use, the bag of the invention, when filled, is carried by insertion of the forearm into the open loops on the surface of the bag and held against the body. In this way, the weight of the load in the bag is borne in large part by the forearm thereby lessening the stress on the lower back muscles.

In a preferred embodiment of the invention, the loops on a surface of the bag are formed of a continuous strip of fabric that forms the loops, reinforces the bag and provides carrying handles at the top of the bag.

DESCRIPTION OF THE PREFERRED EMBODIMENTS OF THE INVENTION

The invention will be better understood by reference to the drawings.

Figure 1:
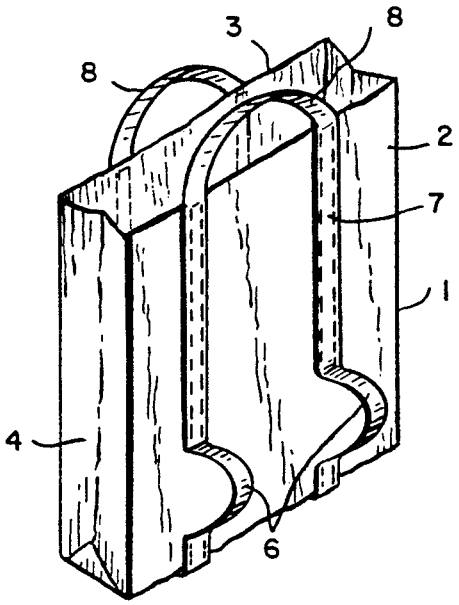
FIG. 1 is an isometric view of an expandable shopping bag in its opened position.
Figure 6:
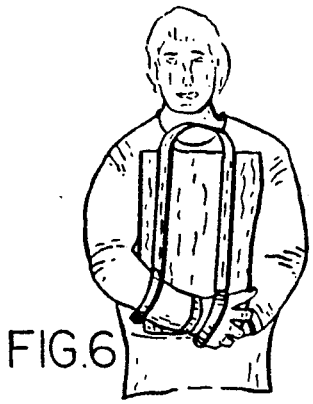
FIG. 6 is an illustration of the bag in use.

FIG. 1 of the drawings comprises an isometric view of the bag of the invention (1) in an open position. The bag is preferably rectangular in shape having front and rear surfaces (2) and (3), side surfaces (4) and bottom surface (5). The bag can be made of any desired material such as cloth or paper. In a preferred embodiment of the bag, the construction material is fabric, more preferably a non-woven fabric such as that sold under the tradename Tyvek by Dupont Corporation.

The bag of the invention is characterized by open loops (6) on at least the front surface of the bag and preferably on both the front and rear surfaces of the bag. It should be recognized that when open loops are provided on both surfaces, only one pair of loops will be used at any given time, but by providing the loops on both surfaces, there is a lesser need to orient the bag to place the loops in the appropriate position during use. Though two open loops are illustrated in the drawings, the bag may have one or multiple loops on any surface. The loops are of a size and shape to accommodate insertion of a forearm into the loops. For example, the loops during use are approximately semicircular in shape with a radius of from about 2.5 to 5 inches though the size and shape of the loop is not critical. When more than one loop is placed on any one surface of the bag, the loops are desirably spaced apart from each other and in face-to-face, parallel relationship to each other. The loops are desirably placed in proximity to the bottom of the bag to facilitate carrying of the bag. For example, the loops may be located within one or several inches from the bottom surface of the bag.

The loops characterizing the bag of the invention are desirably flexible in nature and formed from a pliable material such as fabric. In a preferred embodiment of the invention, the loops are formed from fabric strapping secured to the bag for the dual purposes of forming the loops and reinforcing the bag. Thus, in a preferred embodiment of the invention, strapping (7) runs from top to bottom of the front and rear surfaces of the bag and across the bottom of the bag. The strapping is secured to the bag such as by stitching or gluing except for that segment of the strapping which forms the open loops near the bottom of the bag.

In a preferred embodiment of the invention, the strapping (7) is a continuous strip and is available to form carrying handles at the top of the bag. The carrying handles provide an additional means for carrying the bag when the bag is either empty or contains a light load.

Figure 2:
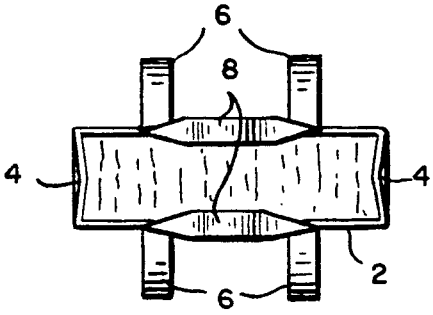
FIG. 2 is a top plan view of FIG. 1.
Figure 4:
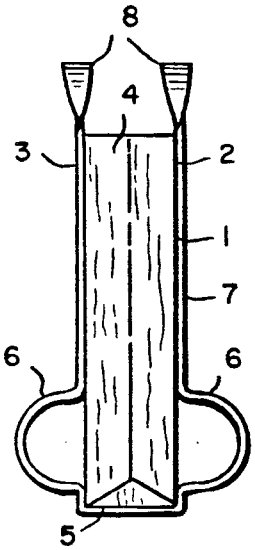
FIG. 4 is a side plan view of FIG. 1.
Figure 3:
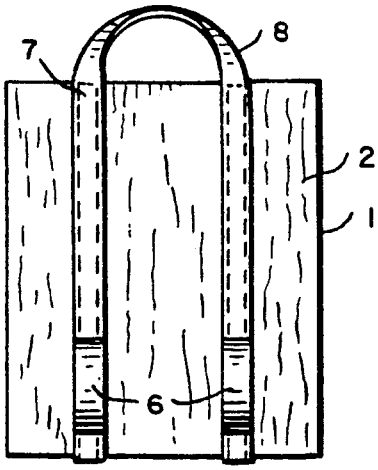
FIG. 3 is a front plan view of FIG. 1
Figure 5:
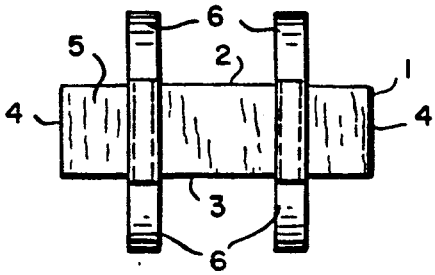
FIG. 5 is a bottom plan view of FIG. 1.

FIG. 2 of the drawings represents a top plan view of the bag of the invention while FIG. 4 illustrates a side view. In each of the figures, the loops (6) can be seen protruding outwardly from the surfaces of the bag. FIG. 3 of the drawings represents a side view of the bag of the invention. From this view, the manner in which the strapping (7) is secured to the bag is better illustrated as is the manner in which the strapping further provides carrying handles at the top of the bag. FIG. 5 of the drawings represents a bottom view of the bag and illustrates how strapping (7) is used to reinforce the bottom surface of the bag.

In use, a forearm is inserted into loops (6) and the bag is pressed against the body. In this way, the weight of the load within the bag is partially displaced from the bag to the forearm thus reducing stress on the lower back muscles.

We claim:

1. A method of carrying a bag having a front surface, a rear surface, two side surfaces, an open top and carrying means comprising straps passing essentially vertically in parallel relationship to each other from top to bottom of the front and rear surfaces of said bag and across the bottom of the bag, said straps defining carrying handles at the to of the bag and loops in proximity to the bottom of the bag on at least the front surface of the bag, said method comprising securing said bag with a forearm inserted into the loops while pressing the bag against the body to thereby distribute a portion of the weight of the bag onto the forearm.

2. The method of claim 1 including the step of inclining the body forward while carrying the bag.

* * * * *